US009002223B2

(12) United States Patent
Yada et al.

(10) Patent No.: US 9,002,223 B2
(45) Date of Patent: Apr. 7, 2015

(54) IMAGE FORMING APPARATUS INCLUDING ANOMALY DETECTION FOR CHARGING MEMBERS

(71) Applicant: Brother Kogyo Kabushiki Kaisha, Nagoya-shi, Aichi-ken (JP)

(72) Inventors: Kengo Yada, Nagoya (JP); Seigo Hayashi, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 27 days.

(21) Appl. No.: 13/751,009

(22) Filed: Jan. 25, 2013

(65) Prior Publication Data

US 2013/0195476 A1 Aug. 1, 2013

(30) Foreign Application Priority Data

Jan. 27, 2012 (JP) ..... 2012-015946

(51) Int. Cl.
*G03G 15/02* (2006.01)
*G03G 13/00* (2006.01)
*G03G 15/00* (2006.01)

(52) U.S. Cl.
CPC ..... *G03G 13/00* (2013.01); *G03G 15/0283* (2013.01); *G03G 15/55* (2013.01)

(58) Field of Classification Search
USPC ..... 399/50, 31
See application file for complete search history.

(56) References Cited

U.S. PATENT DOCUMENTS

| | | | | |
|---|---|---|---|---|
| 5,568,231 | A * | 10/1996 | Asano et al. | 399/175 |
| 5,572,295 | A | 11/1996 | Sakagami et al. | |
| 7,058,333 | B2 * | 6/2006 | Shin | 399/88 |
| 2004/0096236 | A1 * | 5/2004 | Shin | 399/88 |
| 2004/0141766 | A1 * | 7/2004 | Toyama | 399/50 |
| 2007/0147858 | A1 * | 6/2007 | Inukai | 399/31 |
| 2012/0027436 | A1 * | 2/2012 | Maruyama et al. | 399/31 |
| 2012/0027437 | A1 | 2/2012 | Maruyama et al. | |
| 2012/0057888 | A1 * | 3/2012 | Inukai | 399/50 |
| 2012/0082470 | A1 * | 4/2012 | Inukai et al. | 399/31 |
| 2012/0128382 | A1 * | 5/2012 | Kondo et al. | 399/50 |
| 2013/0108295 | A1 * | 5/2013 | Kanehara et al. | 399/50 |
| 2013/0195471 | A1 * | 8/2013 | Kanehara | 399/13 |
| 2013/0195472 | A1 * | 8/2013 | Takami | 399/13 |

FOREIGN PATENT DOCUMENTS

| | | | |
|---|---|---|---|
| JP | H03-142483 | A | 6/1991 |
| JP | H04-003178 | A | 1/1992 |

(Continued)

*Primary Examiner* — G. M. Hyder
(74) *Attorney, Agent, or Firm* — Merchant & Gould PC

(57) ABSTRACT

An image forming apparatus comprises a plurality of photoconductors, a plurality of chargers including charging members, a voltage application unit to which charging members are connected in parallel and which is configured to apply a voltage to the charging members, a controller, and a messaging unit. The controller is configured to change, upon startup, the voltage to be applied by the voltage application unit to the charging members from a previously applied first voltage to a second voltage of which an absolute value is smaller than that of the first voltage, to obtain amounts of electric currents caused to flow through the respective charging members by application of the second voltage. A determination as to whether any anomaly is present is made based upon the obtained amounts of electric currents for the charging members. The messaging unit is configured to produce a notification about presence or absence of anomaly.

5 Claims, 6 Drawing Sheets

(56) References Cited

FOREIGN PATENT DOCUMENTS

| | | | |
|---|---|---|---|
| JP | H04-021875 | A | 1/1992 |
| JP | H05-323773 | A | 12/1993 |
| JP | H06-337600 | A | 12/1994 |
| JP | H07-020686 | A | 1/1995 |
| JP | H07-244420 | A | 9/1995 |
| JP | H11-133765 | A | 5/1999 |
| JP | H11-167241 | A | 6/1999 |
| JP | 2007-086229 | A | 4/2007 |
| JP | 2012-032531 | A | 2/2012 |
| JP | 2012-032532 | A | 2/2012 |
| JP | 2012-113118 | A | 6/2012 |

* cited by examiner

IMAGE FORMING APPARATUS INCLUDING ANOMALY DETECTION FOR CHARGING MEMBERS

CROSS-REFERENCE TO RELATED APPLICATION(S)

This application claims priority from Japanese Patent Application No. 2012-015946 filed on Jan. 27, 2012, the disclosure of which is incorporated herein by reference in its entirety.

FIELD

Apparatuses consistent with one or more aspects of the present invention relate to an image forming apparatus comprising a plurality of charging members configured to charge a plurality of photoconductors, respectively, by a corona discharge.

BACKGROUND

To reduce costs, the image forming apparatus may be configured such that the plurality of charging members are connected in parallel to a single common power source.

In such a configuration, a voltage is applied to the charging members upon startup of the apparatus at a time of closing of a cover for maintenance or at a time of power-up of the apparatus. At this time, if there is one charging member or a subset of charging members having an excessively low resistance for some reason (e.g., because extraneous matter has been removed therefrom by cleaning before the startup), an undesirable overcurrent would possibly flow through this charging member.

SUMMARY

It is one aspect of the present invention to provide an image forming apparatus which is capable of reducing the risk of an overcurrent flowing through one or more charging members.

More specifically, in one or more embodiments, an image forming apparatus is provided which comprises a plurality of photoconductors, a plurality of chargers each disposed opposite to a corresponding photoconductor, a voltage application unit, a controller and a messaging unit. The plurality of chargers comprise a plurality of charging members each of which is provided in a corresponding charger and configured to charge the corresponding photoconductor by a corona discharge. To the voltage application unit, the charging members are connected in parallel. The voltage application unit is configured to apply a voltage to the charging members. The controller is configured to exercise control over the voltage application unit to maintain an amount of an electric current found to be smallest among those of electric currents flowing through the charging members at a predetermined value. The messaging unit is configured to produce a notification to advise a user of presence or absence of an anomaly. The controller is further configured: to change, upon startup of the image forming apparatus, the voltage to be applied by the voltage application unit to the charging members from a previously applied first voltage to a second voltage of which an absolute value is smaller than that of the first voltage, to obtain amounts of electric currents caused to flow through the respective charging members by application of the second voltage; to make a determination as to whether or not any anomaly is present, based upon the obtained amounts of the electric currents for the charging members; and to cause the messaging unit to produce a notification of the anomaly being present, if any anomaly is present.

BRIEF DESCRIPTION OF THE DRAWINGS

The above and other aspects, various embodiments, their advantages and further features of the present invention will become more apparent by describing in detail illustrative, non-limiting embodiments thereof with reference to the accompanying drawings, in which.

DESCRIPTION OF EMBODIMENTS

Figure 1:
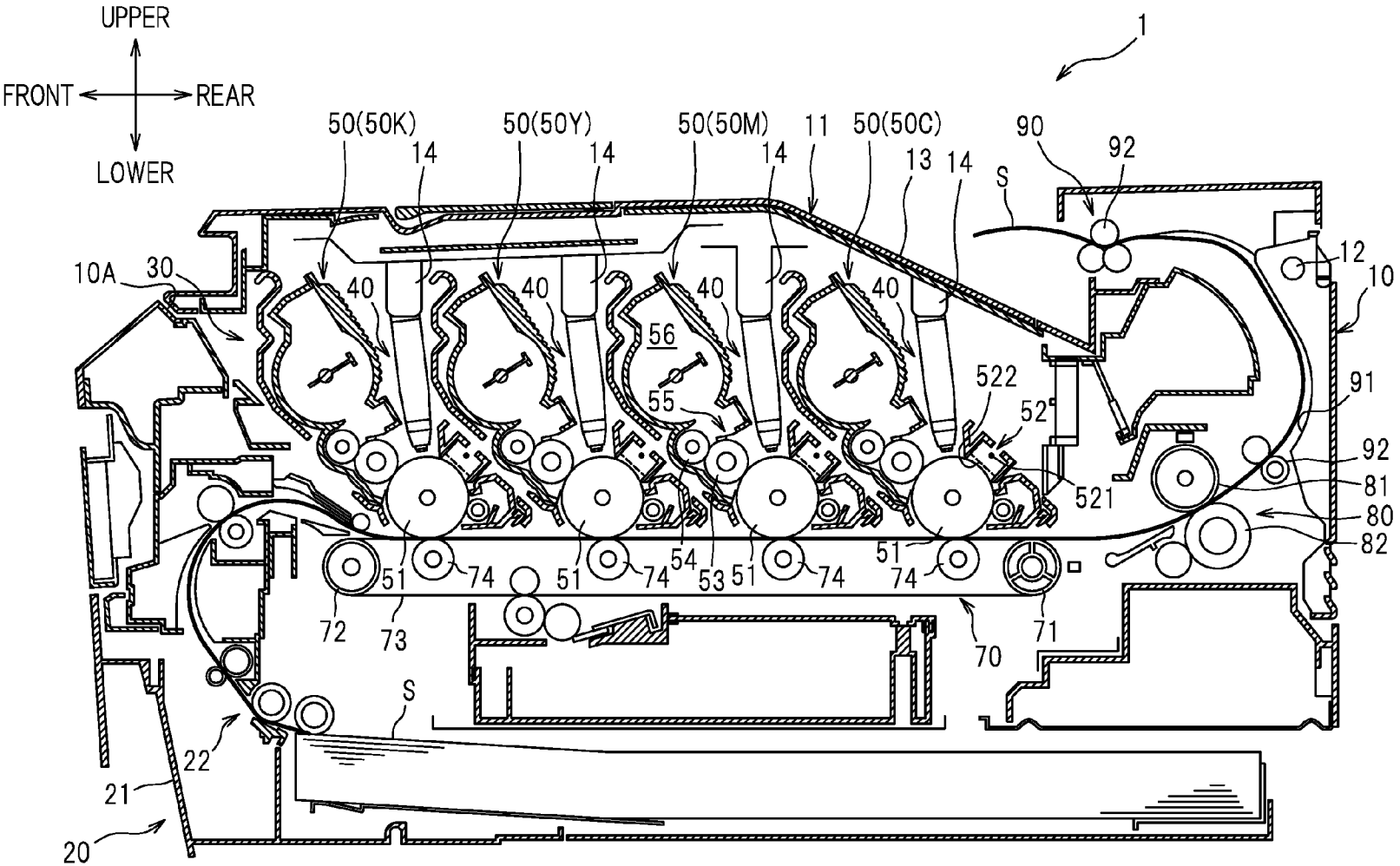
FIG. 1 is a schematic sectional view of a color printer as an example of an image forming apparatus according to one illustrative embodiment of the present invention.

A detailed description will be given of illustrative, non-limiting embodiments of the present invention with reference made to the drawings where appropriate. In the following description, a general setup of a color printer 1 according to one embodiment of the present invention will be described briefly at the outset, and then detailed features of the color printer 1 will be described in detail.

Hereinbelow, in describing the arrangement and operation of each component in the color printer 1, the direction is designated as from the viewpoint of a user who is using (operating) the color printer 1. To be more specific, in FIG. 1, the left-hand side of the drawing sheet corresponds to the "front" side of the printer, the right-hand side of the drawing sheet corresponds to the "rear" side of the printer, the front side of the drawing sheet corresponds to the "right" side of the printer, and the back side of the drawing sheet corresponds to the "left" side of the printer. Similarly, the direction of a line extending from top to bottom of the drawing sheet corresponds to the "vertical" or "up/down (upper/lower or top/bottom)" direction of the printer.

<General Setup of Color Printer>

As shown in FIG. 1, the color printer 1 comprises a main body housing 10, an upper cover 11 as an example of a cover, a sheet feeder unit 20 for feeding a sheet S (e.g., of paper) in the main body housing 10, an image forming unit 30 for forming an image on the sheet S fed by the sheet feeder unit 20, and a sheet output unit 90 for ejecting the sheet S on which an image is formed, to an outside of the main body housing 10.

The upper cover 11 is provided at a top side of the main body housing 10, and configured to be swingable on a pivot 12 located at a rear end thereof (i.e., a front end thereof movable upward and downward) relative to the main body housing 10 to accordingly open and close an opening 10A provided at the top side of the main body housing 10. The opening 10A is an opening provided to render the inside of the main body housing 10 accessible for maintenance of several components installed inside the main body housing 10.

Maintenance of several components of the color printer 1 installed inside the main body housing 10 may include replacement of a process unit 50 (a charger 52 therein) which will be described later by a new one, and cleaning of a charger 52 (a wire electrode 521 thereof). A specific method or structure for cleaning of the charger 52 is known in the art, and thus not detailed herein.

The sheet feeder unit 20 is provided in a bottom space within the main body housing 10, and mainly includes a sheet feed tray 21 configured to store sheets S therein, and a sheet feed mechanism 22 configured to feed a sheet S from the sheet feed tray 21 to the image forming unit 30. Sheets S in the sheet feed tray 21 are separated (uppermost one separated from others) and forwarded one by one to the image forming unit 30 by the sheet feed mechanism 22.

The image forming unit 30 mainly includes four LED units 40, four process units 50, a transfer unit 70, and a fixing unit 80.

The LED units 40 are swingably supported by the upper cover 11. To be more specific, the upper cover 11 includes four holding portions 14 and each LED unit 40 is supported swingably on a corresponding holding portion 14 of the upper cover 11. When the upper cover 11 is in a closed position, each LED unit 40 is disposed opposite to an upper surface of a corresponding photoconductor drum 51. Each LED unit 40 includes a light-emitting part (an array of light-emitting diodes) disposed at a distal end thereof and configured to selectively emit light in accordance with image data, so that a uniformly charged peripheral surface of the corresponding photoconductor drum 51 is exposed to light.

The process units 50 are disposed between the upper cover 11 and the sheet feed tray 21, and arranged in tandem in a front-rear direction. Each process unit 50 is configured to be detachable and installable (replaceable) in a substantially upward-downward direction from and in the main body housing 10 through the opening 10A of the main body housing 10 which becomes available (making the inside of the main body housing 10 accessible) when the upper cover 11 is swung open.

Each process unit 50 includes a photoconductor drum 51 as an example of a photoconductor, a charger 52, a development roller 53, a supply roller 54, a doctor blade 55, and a toner reservoir 56. The toner reservoir 56 is configured to store positively chargeable toner (developer).

The process units 50 are comprised of four process units 50K, 50Y, 50M, 50C for different colors, storing toner of black, yellow, magenta, and cyan, respectively, which are arranged in this sequence from an upstream of a direction of conveyance of a sheet S. In the following description and drawings, each component (i.e., photoconductor drum 51, charger 52, and the like) in a specific process unit 50 will be specified by its color, and designated by appending the corresponding suffix K, Y, M or C to the reference numerals (e.g., a charger 52C in a process unit 50C), where appropriate.

Figure 2:
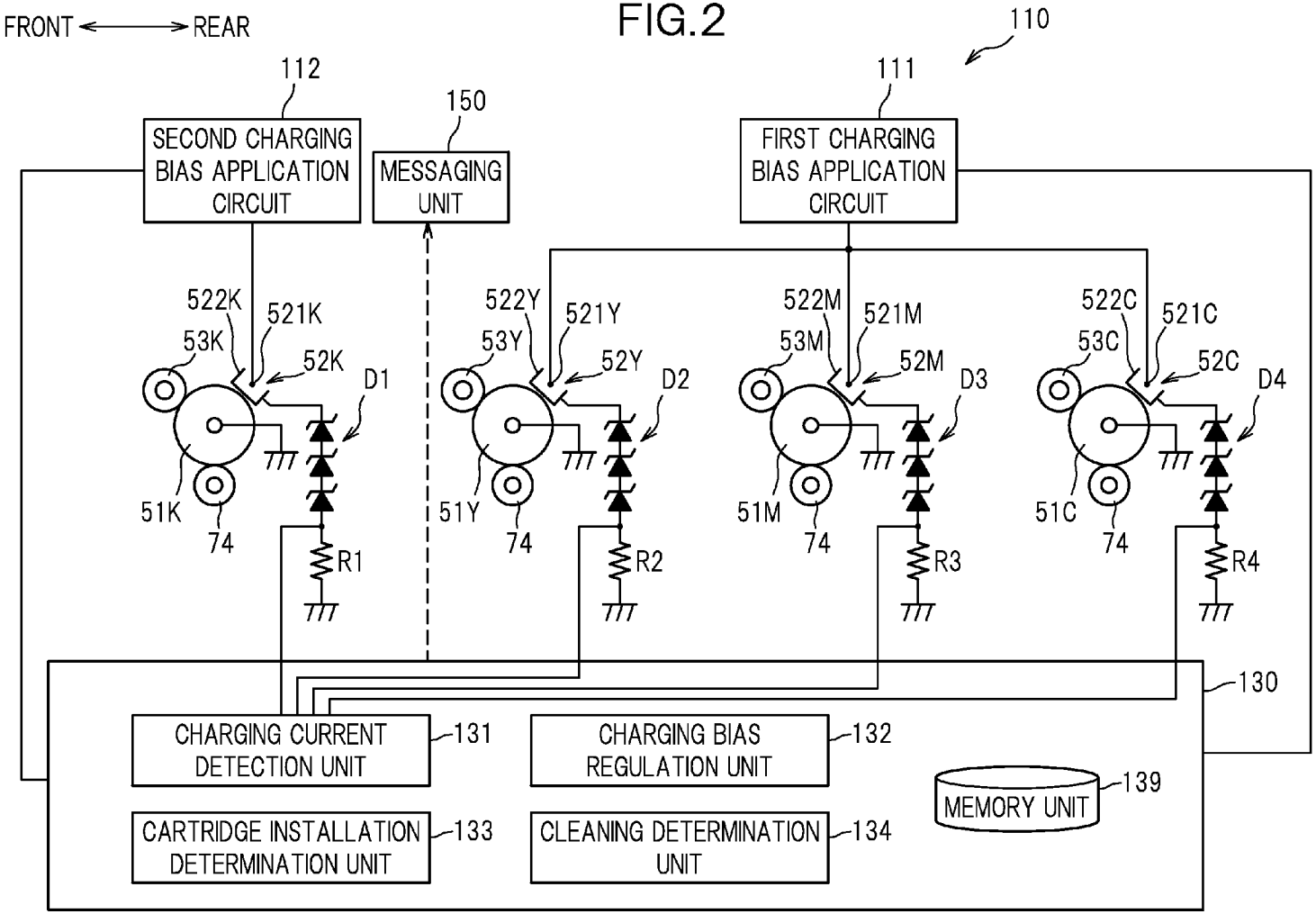
FIG. 2 is a schematic diagram showing chargers and associated systems and elements.

The photoconductor drum 51 is a known photoconductor including a cylindrical drum body possessing an electrical conductivity, a photoconductive (or photosensitive) layer formed on a peripheral surface of the drum body, and a shaft electrically connected to the drum body. The shaft of each photoconductor drum 51 is grounded as shown in FIG. 2.

The charger 52 is provided for each photoconductor drum 51, and mainly includes a wire electrode 521 as an example of a charging member, and a grid electrode 522 disposed between the corresponding photoconductor drum 51 and the corresponding wire electrode 521. This charger 52 is configured to generate a corona discharge when a charging bias (voltage) is applied thereto, so that the peripheral surface of a corresponding photoconductor drum 51 is positively charged.

The transfer unit 70 is disposed between the sheet feed tray 21 and the process units 50, and mainly includes a driving roller 71, a driven roller 72, an endless conveyor belt 73 looped around the driving roller 71 and the driven roller 72, and four transfer rollers 74. The conveyor belt 73 is disposed with its outer surface kept in contact with the peripheral surfaces of the photoconductor drums 51, and the transfer rollers 74 are disposed at an inner surface of the conveyor belt 73 in positions corresponding to the respective photoconductor drums 51, i.e., such that the conveyor belt 73 is held between each transfer roller 74 and the corresponding photoconductor drum 51.

The fixing unit 80 is disposed rearwardly of the process units 50 and the transfer unit 70, and mainly includes a heating roller 81 and a pressure roller 82 disposed opposite to the heating roller 81 and pressed against the heating roller 81.

In the image forming unit 30, the peripheral surfaces of the photoconductor drums 51 are uniformly charged by the chargers 52, and then exposed to light by the LED units 40, so that an electrostatic latent image formulated for each color based upon the image data is formed on the peripheral surface of each photoconductor drum 51.

Toner in each toner reservoir 56 is supplied through the supply roller 54 to the development roller 53, and (as the development roller 53 rotates) forwarded to pass through an interface between the development roller 53 and the doctor blade 55 so that a thin layer of toner having a predetermined thickness is carried on the development roller 53. In this process, the toner is positively charged by friction between the development roller 53 and the supply roller 54 and between the development roller 53 and the doctor blade 55.

When toner carried on the development roller 53 is supplied to an exposed region on the peripheral surface of the photoconductor drum 51, the electrostatic latent image is visualized, and a toner image is thus formed on the peripheral surface of the photoconductor drum 51. Thereafter, while a sheet S fed from the sheet feeder unit 20 is conveyed through an interface between the photoconductor drum 51 and the conveyor belt 73 (behind which the transfer roller 74 with a transfer bias applied thereto is disposed), the toner image formed on the peripheral surface of the photoconductor drum 51 is transferred onto the sheet S. The sheet S with the transferred toner image carried thereon is conveyed through an interface between the heating roller 81 and the pressure roller 82, so that the toner image is thermally fixed on the sheet S.

In the color printer 1, when a multicolor image is formed on a sheet S, toner images are formed on the peripheral surfaces of the photoconductor drums 51 of all the process units 50, and while the sheet S is conveyed to pass through an interface between each photoconductor drum 51 and the conveyor belt 73, toner images for respective colors are transferred one after another, and superposed one on top of another, onto the sheet S. On the other hand, when a monochrome image is formed on a sheet S using black color toner only, a toner image is formed only on the peripheral surface of the photoconductor drum 51K of the process unit 50K where black toner is stored in the toner reservoir 56, and while the sheet S is conveyed to pass through an interface between the photoconductor drum 51K and the conveyor belt 73, the toner image for black is transferred onto the sheet S.

The sheet output unit 90 mainly includes a sheet output path 91 configured to guide a sheet S conveyed out from the fixing unit 80, and a plurality of conveyor rollers 92 configured to convey the sheet S along the sheet output path 91. A sheet S with a toner image thermally fixed thereon (i.e., sheet S on which an image is formed) is conveyed by the conveyor rollers 92 along the sheet output path 91, ejected out of the main body housing 10, and placed on the sheet output tray 13.

<Detailed Configuration of Color Printer>

As shown in FIG. 2, the color printer 1 further comprises a charging bias application device 110, a controller 130 and a messaging unit 150.

The charging bias application device 110 mainly includes a first charging bias application circuit 111 as an example of a voltage application unit, a second charging bias application circuit 112, four constant-voltage circuits D1, D2, D3, D4, and four electric-current detectors R1, R2, R3, R4.

The first charging bias application circuit 111 is connected to three wire electrodes 521Y, 521M, 521C arranged in parallel and thus configured to apply a common charging bias (voltage) to the wire electrodes 521Y, 521M, 521C. The second charging bias application circuit 112 is connected to the wire electrode 521K, and configured to apply a charging bias to this wire electrode 521K.

In the present embodiment, the second charging bias application circuit 112 connected only to the wire electrode 521K is provided separately from the first charging bias application circuit 111 connected to the wire electrodes 521Y, 521M, 521C. Therefore, the charging bias applied to the wire electrode 521K can be regulated independently. A specific configuration of the circuit for applying a charging bias to the wire electrode 521 is known in the art, and a detailed description thereof is omitted herein.

The constant-voltage circuits D1-D4 are each composed of three Zener diodes connected in series, and configured such that the voltage applied to the grid electrode 522 of each charger 52 remains constant. The electric-current detectors R1-R4 are each composed of a resistor of which one end is connected to a corresponding constant-voltage circuit D1, D2, D3 or D4 and the other end is grounded.

The controller 130 is composed of several elements (not shown) which include a CPU, a RAM, a ROM, an input/output interface, and others. The controller 130 is configured to exercise control over various components (e.g., image forming unit 30, charging bias application device 110, etc.) of the color printer 1 in accordance with preconfigured programs and the like. This controller 130 is configured to start up the color printer 1 when a sensor (not shown) detects that the upper cover 11 has been operated from an open position to a closed position, so that a warming-up operation (initial operation for preparation of printing) is started, for example, by causing the image forming unit 30 and other components to operate, to agitate toner in the toner reservoir 56, and to heat the heating roller 81.

The controller 130 comprises a plurality of functional units of which those related to the present invention mainly include a charging current detection unit 131, a charging bias regulation unit 132, a cartridge installation determination unit 133, a cleaning determination unit 134 and a memory unit 139. The cartridge installation determination unit 133 and the cleaning determination unit 134 are used to determine whether or not any anomaly is present (presence or absence of anomaly in the color printer 1).

The charging current detection unit 131 has a function of detecting charging currents flowing through four wire electrodes 521, individually. To be more specific, the charging current detection unit 131 is wired to four points each located on connecting lines between one constant-voltage circuit D1, D2, D3 or D4 and a corresponding electric-current detector R1, R2, R3 or R4, so that the charging current detection unit 131 obtains a voltage in proportion to the magnitude of the charging current of each wire electrode 521 (more precisely, the electric current of each grid electrode 522). With this configuration, the charging current detection unit 131 takes a reading of the obtained voltage, to thereby detect a charging current flowing through each wire electrode 521.

From the charging currents flowing through the four wire electrodes 521 individually detected in the charging current detection unit 131 as described above, the controller 130 can obtain information on the presence or absence of each process unit 50 including a corresponding wire electrode 521 (i.e., whether or not each process unit 50 is installed), or the necessity for cleaning of each wire electrode 521, individually (for each color), as will be described later.

The charging current detection unit 131 also has a function of recording amounts of electric currents flowing through the respective wire electrodes 521Y, 521M, 521C (AY1, AM1, AC1 in FIG. 3) as previous values in the memory unit 139, at each time of predetermined timing ("a predetermined time") in the printing control process. This predetermined time may be any point of time in the printing control process, which includes, for example, at a time when an image is formed on one sheet S, at a time when a processing for one printing job as instructed in the color printer 1 is completed, or at a time when a processing for a set of printing jobs as instructed in the color printer 1 are all completed (i.e., at a time of ending of printing). Alternatively, such "a predetermined time" in the printing control may be a time, for example, when the value of a charging bias applied to each charger 52 changes.

The charging bias regulation unit 132 is configured to exercise control over the first charging bias application circuit 111 and the second charging bias application circuit 112, individually, to regulate charging biases applied to the respective chargers 52. To be more specific, the charging bias regulation unit 132 is configured to execute a constant-voltage control and a constant-current control in the control over the first charging bias circuit 111 and the second charging bias circuit 112.

The constant-voltage control is a control scheme in which the first and second charging bias application circuits 111, 112 are controlled so that the charging bias applied to the chargers 52 is maintained at a predetermined bias value (predetermined voltage value) which will be described later.

The constant-current control is a control scheme in which the first charging bias application circuit 111 is controlled so that an amount of an electric current found to be smallest among those of charging currents flowing through the chargers 52Y, 52M, 52C by application of a charging bias is maintained at a predetermined value, while the second charging bias application circuit 112 is controlled so that an amount of a charging current flowing through the charger 52K by application of a charging bias is maintained at a predetermined value.

By executing the constant-current control in which the first charging bias application circuit 111 is controlled so that an amount of an electric current found to be smallest among those of charging currents flowing through the chargers 52Y, 52M, 52C by application of a charging bias is maintained at a predetermined value, the surface potentials of the charged photoconductor drums 51Y, 51M, 51C can be maintained at a desired value or greater. Therefore, a potential difference between the exposed region and an unexposed region on the photoconductor drums 51 during the printing operation is made greater to some extent such that adhesion of toner to the unexposed region can be suppressed and the risk of degradation in image quality such as a phenomenon called "fogging" can be suppressed.

In the present embodiment, upon startup of the color printer 1, the charging bias regulation unit 132 regulates the voltages applied by the first charging bias application circuit 111 and the second charging bias application circuit 112 to thereby execute the constant-voltage control. In this control process, the charging bias regulation unit 132 regulates the voltage applied to the charger 52K (the wire electrode 521K thereof) by the second charging bias application circuit 112 to a value (predetermined bias value) of a previously applied voltage which is retrieved from the memory unit 139. Moreover, the charging bias regulation unit 132 regulates the voltage applied to the chargers 52Y, 52M, 52C (the wire electrodes 521Y, 521M, 521C thereof) by the first charging bias application circuit 111 to a value (predetermined bias value) of a second charging bias of which an absolute value is smaller than that of a previously applied first charging bias which is retrieved from the memory unit 139.

The second charging bias (second voltage) may be set appropriately at a fixed value predetermined by experiment or simulation or a value obtained by calculation using a predetermined formula. Such a fixed value may be, for example, a value smaller than the smallest value of the voltage applied in the printing control process (the value of voltage applied to wire electrodes 521 if they are all new, thus not contaminated and have resistances of their specification values). A value obtained by calculation usable for this purpose may be, for example, a value on the order of 70-80% of the previous value of the first charging bias (first voltage).

After starting the constant-voltage control process, if the cartridge installation determination unit 133 (which will be described later) determines that all the process units 50 are installed in the main body housing 10 and the cleaning determination unit 134 determines that all the wire electrodes 521 are not in need of cleaning, then the charging bias regulation unit 132 switches the control scheme adopted in regulation of the voltages applied by the first and second charging bias application circuits 111, 112, from the constant-voltage control to the constant-current control.

The charging bias regulation unit 132 also has a function of recording a value of a charging bias applied to the charger 52K and a value of a charging bias (first charging bias) applied to the chargers 52Y, 52M, 52C, respectively, as previous values in the memory unit 139, at each time of predetermined timing (i.e., the aforementioned "predetermined time") in the printing control process.

The cartridge installation determination unit 133 has a function of determining whether or not each process unit 50 is installed in the main body housing 10. To be more specific, the cartridge installation determination unit 133 is configured to obtain amounts of charging currents flowing through chargers 52 individually during the constant-voltage control, and determine whether each of the obtained amounts of the charging currents is not greater than a predetermined installation determination reference value. If any of the obtained amounts of charging currents exhibits a value not greater than the installation determination reference value, then the cartridge installation determination unit 133 determines that a process unit 50 including the corresponding charger 52 is not installed, while if any of the obtained amounts of charging currents exhibits a value greater than the installation determination reference value, then the cartridge installation determination unit 133 determines that a process unit 50 including the corresponding charger 52 is installed.

The cartridge installation determination unit 133, once determines that any process cartridge 50 is not installed (i.e., an anomaly is present), outputs information to that effect to the messaging unit 150. Accordingly, the messaging unit 150 can produce a notification of the anomaly (information that any of the process units 50 is not installed) to advise a user to that effect.

The cleaning determination unit 134 has a function of determining whether or not each wire electrode 521 is in need of cleaning.

To make a determination as to whether or not each of the wire electrodes 521Y, 521M, 521C for yellow, magenta, cyan (other than black) is in need of cleaning, specifically, the cleaning determination unit 134 is configured to calculate an absolute value of a difference between a maximum amount found to be largest among the amounts of the charging currents flowing through the wire electrodes 521Y, 521M, 521C as obtained by the charging current detection unit 131 at a time of startup of the color printer 1 (during the constant-voltage control) or any other appropriate time in the subsequent operation and each of the obtained amounts other than the maximum amount, and to make a determination as to whether or not the calculated absolute value for each wire electrode 521 is equal to or greater than a predetermined first cleaning determination reference value (first reference value) determined by experiment or the like.

If the calculated absolute value is equal to or greater than the first cleaning determination reference value, then the cleaning determination unit 134 makes a determination that the wire electrode 521 for which the calculated absolute value is equal to or greater than the first cleaning determination reference value (one of the wire electrodes 521 other than the wire electrode 521 having the maximum amount) is in need of cleaning. On the other hand, if the calculated absolute value is smaller than the first cleaning determination value, then the cleaning determination unit 134 makes a determination that the wire electrode 521 for which the calculated absolute value is smaller than the first cleaning determination reference value is not in need of cleaning.

Figure 3:
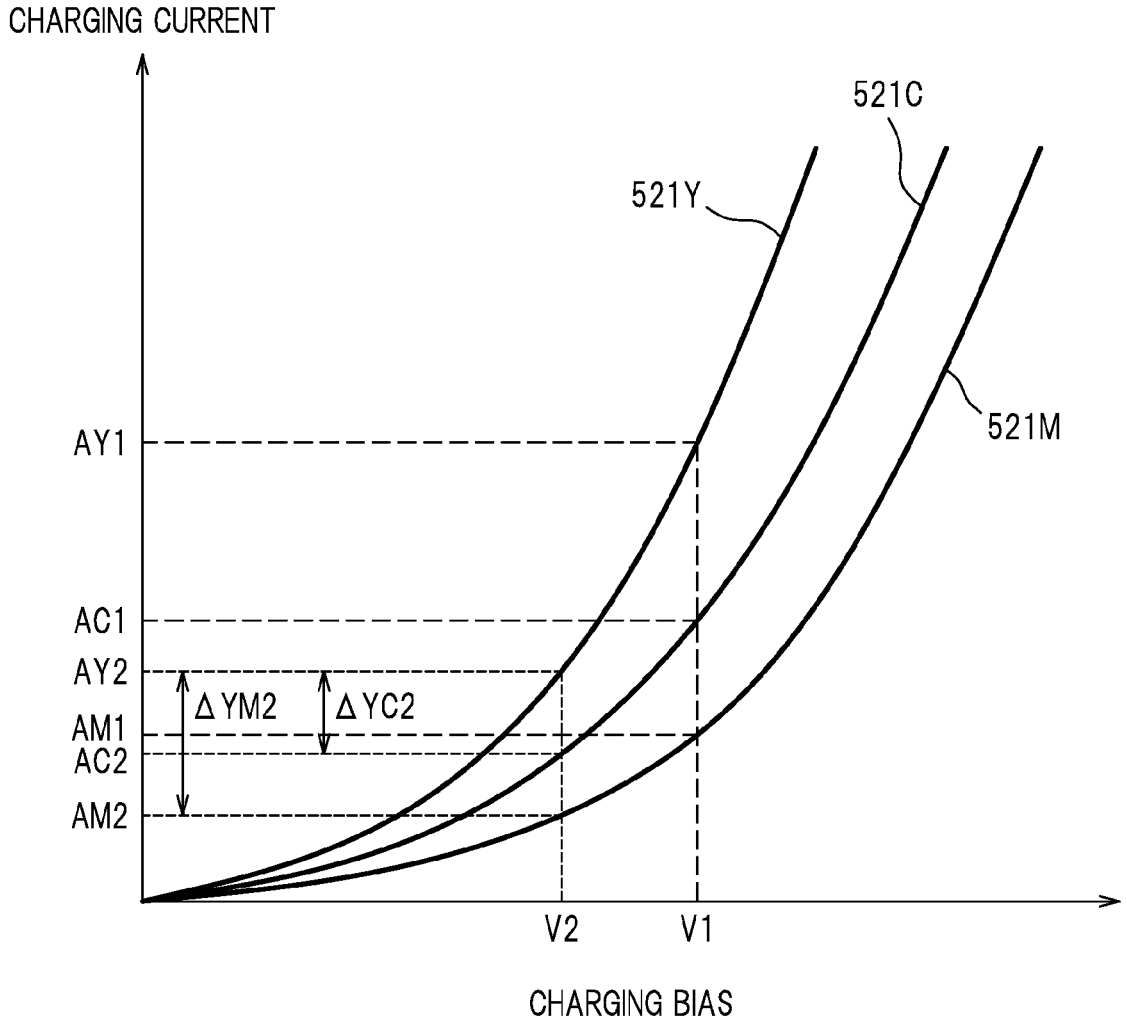
FIG. 3 is a graph showing relationships between charging bias and charging current.

To be more specific, as shown in FIG. 3, for example, if a charging current AY2 (first current) flowing through the wire electrode 521Y has the maximum amount under the constant-voltage control (where the second charging bias V2 is being applied), the cleaning determination unit 134 calculates a difference between the amount of the charging current AY2 and each of the amounts of the charging currents AM2, AC2 (second currents) flowing through the other wire electrodes 521M, 521C; that is, in this embodiment, a difference ΔYM2 (=|AY2−AM2|) between the largest charging current AY2 and the amount of charging current AM2 flowing through the wire electrode 521M, and a difference ΔYC2 (=|AY2−AC2|) between the largest charging current AY2 and the amount of charging current AC2 flowing through the wire electrode 521C are calculated. If the difference ΔYM2 is equal to or greater than the first cleaning determination reference value, then the cleaning determination unit 134 determines that the wire electrode 521M corresponding to the charging current AM2 is in need of cleaning. If the difference ΔYC2 is smaller than the first cleaning determination reference value, then the cleaning determination unit 134 determines that the wire electrode 521C corresponding to the charging current AC2 is not in need of cleaning.

To make a determination as to whether or not the wire electrode 521K is in need of cleaning, the cleaning determination unit 134 determines whether or not the amount of a charging current flowing through the wire electrode 521K as obtained from the charging current detection unit 131 is equal to or smaller than a predetermined second cleaning determination reference value determined by experiments or the like. If the amount of charging current flowing through the wire electrode 521K is equal to or smaller than the second cleaning determination reference value, then the cleaning determination unit 134 determines that the wire electrode 521K is in need of cleaning, and if the amount of charging current flowing through the wire electrode 521K is greater than the second cleaning determination reference value, then the cleaning determination unit 134 determines that the wire electrode 521K is not in need of cleaning.

When the cleaning determination unit 134 determines that any wire electrode 521 is in need of cleaning (i.e., anomaly is present), the cleaning determination unit 134 outputs information to that effect to the messaging unit 150. Accordingly, the messaging unit 150 can produce a notification of the anomaly (information that any of the wire electrodes 521 is in need of cleaning) to advise a user to that effect.

The messaging unit 150 has a function of producing a notification of an anomaly (i.e., information that any of the process units 50 is not installed, or information that any of the wire electrodes 521 is in need of cleaning) to advise a user of such anomaly information. In the present embodiment, the messaging unit 150 is further configured to be able to notify a user which process unit 50 is not installed, and which wire electrode 521 is in need of cleaning, individually.

The messaging unit 150 may, for example, comprise four LED lamps (not shown) which are provided on the main body housing 10 or the like as indicators for respective process units 50, whereby a user can be notified, from lit or unlit statuses of these LED lamps, of the status of installation for each of the four process units 50, i.e., which is installed and which is not installed. Furthermore, the messaging unit 150 may, for example, comprise a liquid crystal display which is provided on the main body housing 10 or the like, whereby a color name of the wire electrode(s) 521 in need of cleaning can be displayed so that a user can be notified of the need of cleaning for each of the wire electrodes 521. Furthermore, the messaging unit 150 may be configured to produce a voice or sound message to advise a user of information by voice or sound.

Next, a detailed description will be given of the process of control exercised by the controller 130, with reference to flowcharts shown in FIGS. 4 and 5.

Figure 4:
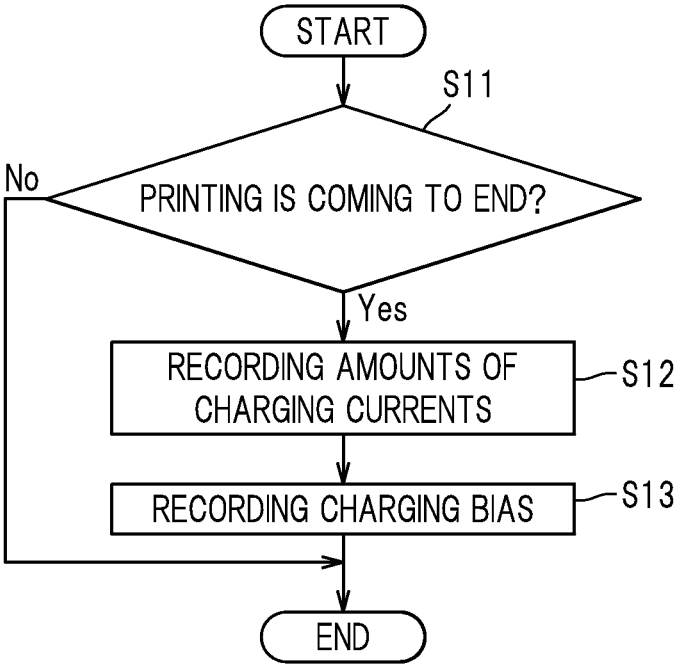
FIG. 4 is a flowchart showing an operation performed by a controller when a printing operation ends.

The controller 130 is configured to repeatedly execute the process shown in the flowchart of FIG. 4 during the normal printing control after startup of the color printer 1. To be more specific, the controller 130 first determines whether or not a predetermined time in the control process has come, for example, in the present embodiment, by determining whether or not the printing is coming to an end (S11). If the controller 130 makes a determination that the printing is coming to an end (Yes in step S11), then the controller 130 records values (amounts) of charging currents flowing through the chargers 52Y, 52M, 52C at the time when the printing has come to an end (S12), and records a value (first charging bias) of the charging bias applied to the chargers 52Y, 52M, 52C at the time when the printing has come to an end (S13).

Figure 5:
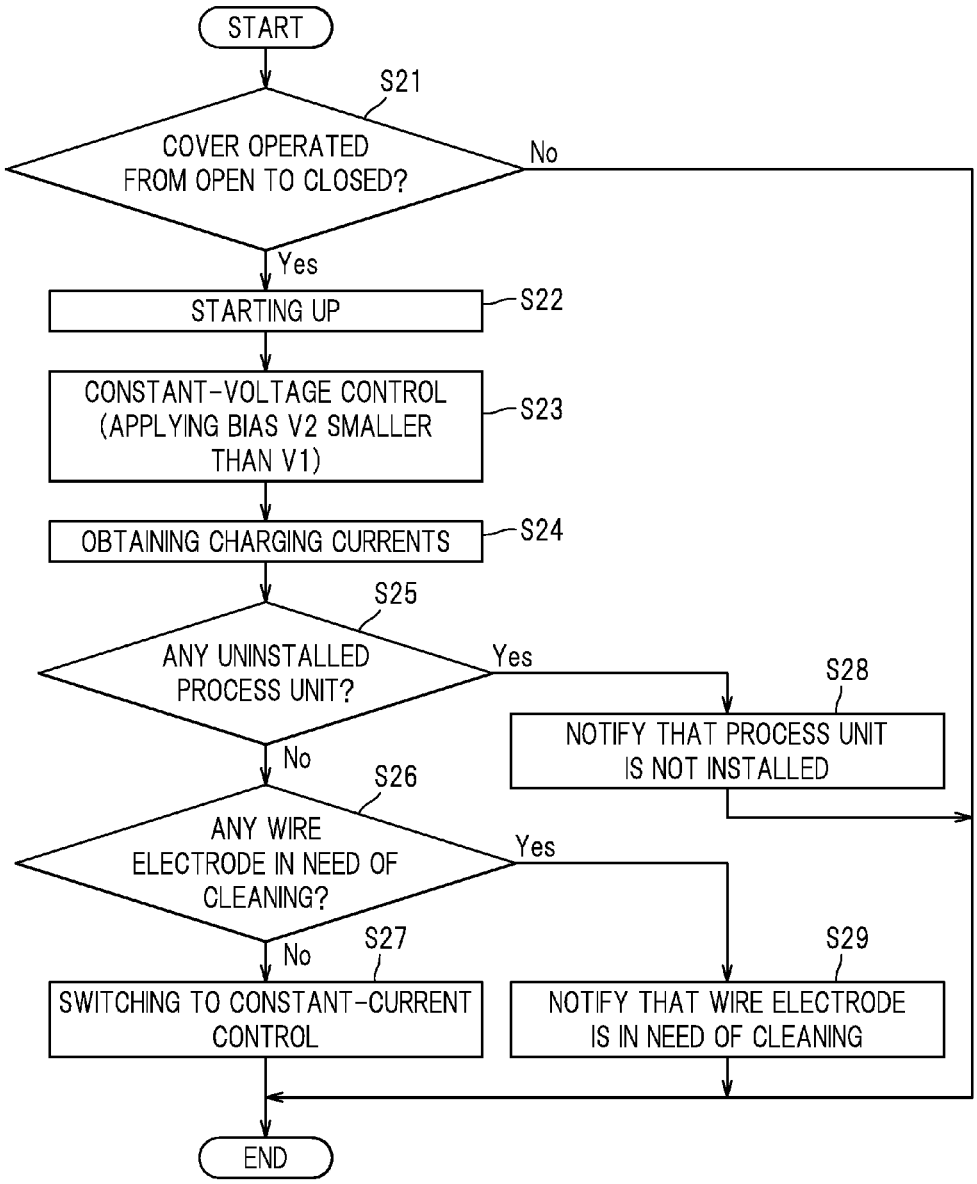
FIG. 5 is a flowchart showing an operation performed by the controller upon startup of the color printer.

As shown in FIG. 5, if the upper cover 11 is operated from the open state to the closed state (Yes in step S21), then the controller 130 starts up the color printer 1 to start the warming-up operation (S22), and executes the constant-voltage control (S23). At this time, the controller 130 applies a second charging bias V2 smaller than the first charging bias V1 recorded in step S13 to the wire electrodes 521Y, 521M, 521C.

After starting execution of the constant-voltage control, the controller 130 obtains an amount of a charging current from each grid electrode 522 (S24), and makes a determination as to whether there is any uninstalled process unit 50 (S25) and a determination as to whether there is any wire electrode 521 in need of cleaning (S26) based upon the obtained amount of the charging current and the recorded amount of the corresponding charging current (previous value) for each wire electrode 521. It is to be understood that the sequence (order) of the steps S25 and S26 may be reversed, or the steps S25 and S26 may be executed simultaneously.

In step S25, if the controller 130 makes a determination that the process unit 50Y is not installed (Yes in step S25), the controller 130 causes the messaging unit 150 to notify a user of information to the effect that the process unit 50Y is not installed (S28), and brings the process to an end. In this example, the user may open the upper cover 11, install the process unit 50Y and close the upper cover 11 (Yes in step S21), and the controller 130 again executes the process of step S22 and subsequent steps, and then makes a determination that all the process units 50 are installed (No in step S25).

In step S26, if the controller 130 makes a determination that one wire electrode, for example, the wire electrode 521M, is in need of cleaning (Yes in step S26), then the controller 130 causes the messaging unit 150 to notify a user of information to the effect that the wire electrode 521M is in need of cleaning (S29), and brings the process to an end. In this example, the user may open the upper cover 11, remove the corresponding process unit 50M, subject the wire electrode 521M to cleaning, install the process unit 50M back into the main body housing 10, and close the upper cover 11 (Yes in step S21), and the controller 130 again executes the process of step S22 and subsequent steps, and then makes a determination that all the wire electrodes 521 are not in need of cleaning (No in step S26).

If the controller 130 determines that all the process units 50 are installed (No in step S25) and that all the wire electrodes 521 are not in need of cleaning (No in step S26), then the controller 130 switches its control scheme adopted for control over the first charging bias application circuit 111 and the second charging bias application circuit 112 from the constant-voltage control to the constant-current control (S27), and brings the process shown in the flowchart of FIG. 5 to an end. Thereafter, when a printing job is inputted into the color printer 1, the controller 130 executes the constant-current control under which a printing operation (operation for forming an image on a sheet S) is carried out.

According to the present embodiment, the following advantages can be achieved.

Since the voltage to be applied to the wire electrodes 521Y, 521M, 521C upon startup of the color printer 1 is changed from a previously applied first charging bias (voltage) to a second charging bias (voltage) of which an absolute value is smaller than that of the first charging bias, even if there is a wire electrode 521 subjected to cleaning and thus having a resistance lower than those of other wire electrodes 521, the risk of an undesirable overcurrent flowing through this wire electrodes 521 can be reduced. Accordingly, an excessive electric discharge can be suppressed so that generation of ozone associated with the corona discharge can be reduced, and the useful life of the corresponding photoconductor drum 51 can be increased, for example.

Since the present embodiment is configured, particularly such that the startup of the color printer 1 as a trigger for application of the second charging bias smaller than the previously applied first charging bias takes place when the upper cover 11 is operated from the open state to the closed state, the overcurrent which would flow through the wire electrode(s) 521 can be suppressed effectively, because when the upper cover 11 is operated from the open state to the closed state, the wire electrode(s) 521 would be more likely to be subjected to cleaning before closing of the upper cover 11 and would thus have a lower resistance with greater probability.

In the present embodiment, the constant-voltage control is exercised under which the second charging bias lower than the previously applied first charging bias is applied to the wire electrodes 521Y, 521M, 521C upon startup of the color printer 1. If the constant-current control is exercised instead upon startup of the color printer 1, the risk of overcurrent flowing through the wire electrode(s) 521 would be enhanced.

To be more specific, supposing for example that the wire electrode 521Y has the lowest resistance before opening of the upper cover 11 and this wire electrode 521Y is subjected to cleaning after opening the upper cover 11, the resistance of the wire electrode 521Y will become extremely lower than the other wire electrodes 521M, 521C. Under the circumstances, if the constant-current control is exercised upon startup of the color printer (i.e., after closing of the upper cover 11), the absolute value of the charging bias to be applied to the wire electrodes 521 would be increased because the amount of an electric current flowing through one of the wire electrodes 521M, 521C of which the resistance is highest is regulated to exhibit a predetermined value. Consequently, the risk of the overcurrent flowing through the wire electrode 521Y of which the resistance is lowest would be enhanced.

Furthermore, if the wire electrode 521M is contaminated with much dirt for some reason while the upper cover 11 is opened, then the resistance of the wire electrode 521M will become extremely higher than the other wire electrodes 521Y, 521C. Under the circumstances, if the constant-current control is exercised upon startup of the color printer (i.e., after closing of the upper cover 11), the absolute value of the charging bias to be applied to the wire electrodes 521 would be increased because the amount of electric currents flowing through the wire electrode 521M of which the resistance is highest is regulated to exhibit a predetermined value. Consequently, the risk of the overcurrent flowing through the other wire electrodes 521Y, 521C would be enhanced.

In the present embodiment, the constant-voltage control is exercised under which the second charging bias lower than the previously applied first charging bias is applied to the wire electrodes 521Y, 521M, 521C upon startup of the color printer 1. Therefore, even if there is any wire electrode 521 of which the resistance is extremely higher or extremely lower than the other wire electrodes 521, the risk of the overcurrent flowing through these wire electrodes 521 can be reduced.

Moreover, since a determination as to the presence or absence of any anomaly (any uninstalled process unit 50 and any wire electrode 521 in need of cleaning) is made based upon the amount of an electric current flowing through each wire electrode 521 as obtained by application of the charging bias, and if it is determined that any anomaly is present, then the messaging unit 150 is caused to produce a notification of the anomaly being present, a user can be notified of the presence of the uninstalled process unit 50 or the wire electrode 521 in need of cleaning.

Since the determination as to whether or not each of the wire electrodes 521Y, 521M, 521C is in need of cleaning is made by calculating the difference between a maximum amount found to be largest among the obtained amounts of the charging currents and each of the obtained amounts other than the maximum amount, and any wire electrode 521 of which an amount of a charging current is not the maximum amount and for which the calculated difference is equal to or greater than the first reference value is determined to be in need of cleaning, the determination can be made with reference to the maximum value (amount found largest among the charging currents flowing through the wire electrodes 521, i.e., one wire electrode 521 which has the lowest resistance and is least contaminated can be used for the determination whether or not any of the other wire electrodes 521 is in need of cleaning. This is advantageous for improved accuracy in determination of the need of cleaning for each wire electrode 521, in comparison with an alternative method of making a determination based upon a difference between the amounts of charging currents which are not the maximum value.

Furthermore, since the amounts of charging currents flowing through wire electrodes 521 for use in determination are obtained from the amounts of electric currents flowing through the corresponding grid electrodes 522 which are not susceptible to the surface potential conditions of the photoconductor drums 51, it is ensured that the amounts of electric current obtained are accurate. Accordingly, the accuracy of determination as to uninstalled process units 50 and wire electrodes 521 in need of cleaning can be improved.

Although one illustrative embodiment has been described above, the present invention is not limited to this illustrative embodiment. Modifications and changes may be made where appropriate to its specific configurations without departing from the spirit and scope of the present invention.

In the above-described embodiment, three of the total four chargers 52 are connected in parallel to a common voltage application unit (first charging bias application circuit 111), but the present invention is not limited to this specific configuration. For example, all the chargers may be connected in parallel to one and the same voltage application unit. Alternatively, two voltage application unites may be connected, respectively, to two sets of chargers connected in parallel, respectively. Although the above-described embodiment is configured to have three chargers 52Y, 52M, 52C connected in parallel to the common voltage application unit, but the present invention is not limited to this specific configuration; i.e., an alternative configuration may be feasible in which two chargers are connected in parallel to a common voltage application unit and the remaining one charger is connected independently to another voltage application unit, like the charger 52K of the above-described embodiment. For example, only the two wire electrodes 52M, 52C may be connected in parallel to a common voltage application unit.

In the above-described embodiment, the messaging unit 150 is configured to produce a notification to advise a user of information as to whether each of the wire electrodes 521 (charging members) is in need of cleaning, but the present invention is not limited to this specific configuration. For example, the messaging unit 150 may alternatively be configured to produce a notification to advise a user to subject all the charging members to cleaning if even one charging member is determined to be in need of cleaning. With this alternative configuration, an inadvertent mix-up between charging members in need and not in need of cleaning can be prevented, and all the charging members are subjected to cleaning by the user so that the conditions of all the charging members can be improved uniformly.

In the above-described embodiment, as shown in FIG. 3, for example, the difference ΔYM2 between the amount of charging current AY2 flowing through the wire electrode 521Y (maximum amount found to be largest among others) by application of the second charging bias V2 and the amount of charging current AM2 flowing through the wire electrode 521M by application of the second charging bias V2 is compared with the first cleaning reference value, and if the difference ΔYM2 is equal to or greater than the first cleaning reference value, then it is determined that the wire electrode 521M is in need of cleaning, but the present invention is not limited to this specific configuration. In other words, the method of determination as to whether or not each wire electrode 521Y, 521M, 521C is in need of cleaning is described above only by way of example, and the determination may be made in any other ways which may also be consistent with the present invention.

Figure 6:
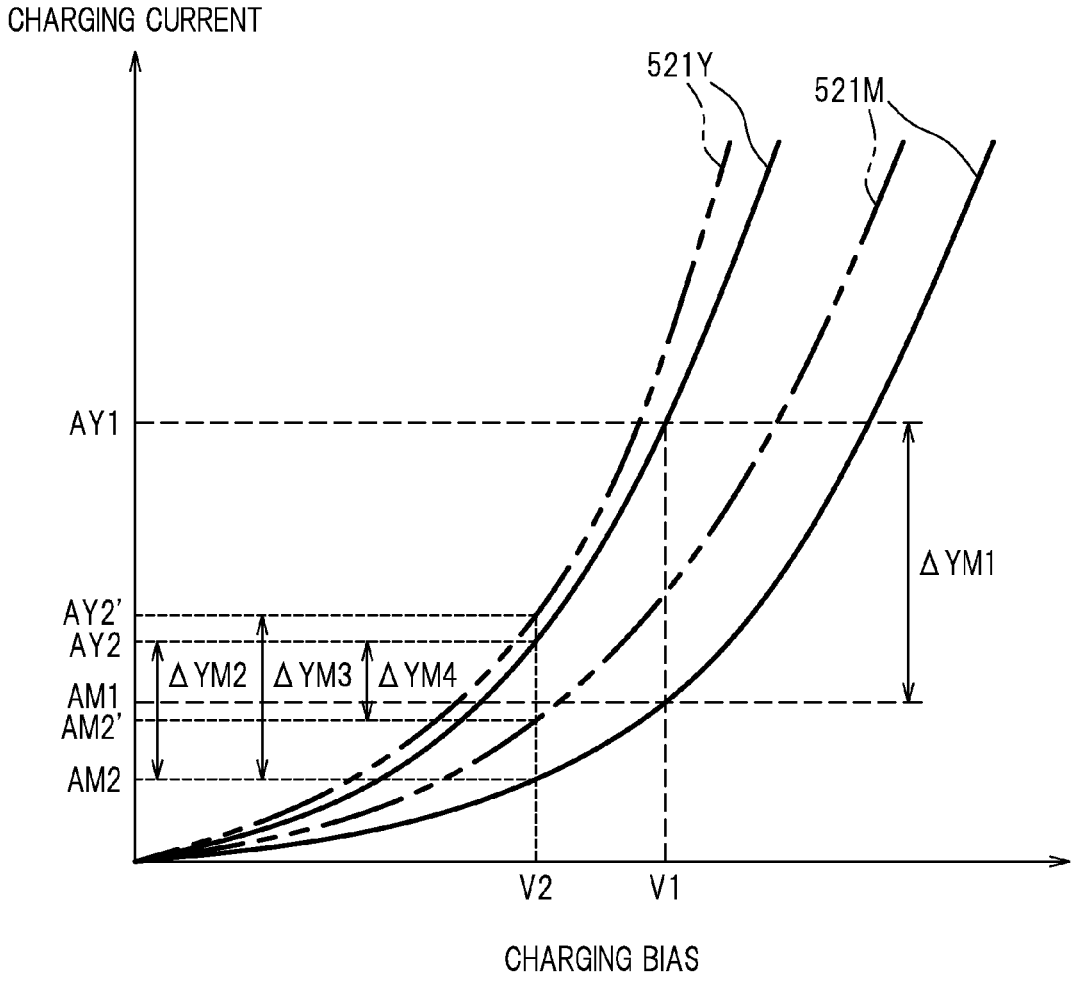
FIG. 6 is a graph showing relationships between charging bias and charging current, for explaining the necessity of cleaning for wire electrodes in a modified embodiment.

As shown in FIG. 6, for example, the charging currents flowing through the respective wire electrodes 521Y, 521M with respect to the charging bias applied to the wire electrodes 521 have characteristics as graphically represented as maps designated by reference characters 521Y, 521M. Therefore, the maps as shown in FIG. 6 may be recorded in advance. The maps recorded may be of several kinds corresponding to the number of times of use of the wire electrode 521. When the second charging bias V2 is applied upon startup of the color printer 1, a map for each wire electrode 521 can be identified from the amount of a charging current caused to flow through the wire electrode 521 by application of the second charging bias V2. Thus, the amount of the charging current caused to flow through the wire electrode 521 by application of the first charging bias V1 can be obtained from the identified map. The difference between two obtained amounts of charging currents can be calculated accordingly.

By making use of the principle as explained above, for example, the controller 130 may identify two corresponding maps (see solid lines) stored (recorded) in the memory unit 139 from the amounts of charging currents AY2, AM2 caused to flow by application of the second charging biases V2. Thereafter, the controller 130 may determine the amounts of charging currents AY1, AM1 from the maps identified as described above and the previously applied first charging bias V1, and calculate the difference ΔYM1 between the amounts of charging currents AY1, AM1. If the calculated difference ΔYM1 is equal to or greater than a reference value predetermined by experiments or the like, the controller 130 may then determine that the wire electrode 521M is in need of cleaning; on the other hand, if the calculated difference ΔYM1 is smaller than the reference value, the controller 130 may then determine that the wire electrode 521M is not in need of cleaning.

Although the first cleaning reference value (reference value) for use in determination as to whether or not each wire electrode 521Y, 521M, 521C is in need of cleaning is a predetermined fixed value in the above-described embodiment, the present invention is not limited to this specific configuration. For example, the reference value may be determined based upon a map, a formula, a table and the like predetermined (and stored) from the relationship between the charging bias applied to the wire electrode 521 and the charging current caused to flow through the wire electrode 521 by application of the charging bias.

To be more specific, for example, where maps as shown in FIG. 6 are stored beforehand, the controller 130 may be configured to identify maps indicated by solid lines from the amounts of charging currents AY1, AM1 caused to flow through the charging electrodes 521Y, 521M, respectively, by application of the first charging bias V1 at the time of ending of printing, determine the charging currents AY2, AM2 based upon the identified maps (solid lines) and the second charging bias V2 to be applied next, and calculate the difference ΔYM2 between the charging currents AY2, AM2 as a reference value (as an example of a second reference value) in advance.

In this configuration, the controller 130 may be configured to determine that an anomaly is present (i.e., the need of cleaning is present), if the difference (an absolute value thereof) between the amounts of charging currents caused to flow through the wire electrodes 521Y, 521M by actual application of the second charging bias V2 after startup of the color printer 1 is greater than the reference value ΔYM2.

To describe this configuration more in detail, a reference is now made to FIG. 6. If the both wire electrodes 521Y, 521M are not subjected to cleaning, the resistances of the wire electrodes 521Y, 521M will not change (see maps 521Y, 521M indicated by solid lines). Thus, the difference ΔYM2 between the amounts of charging currents AY2, AM2 caused to flow through the wire electrodes 521Y, 521M, respectively, by application of the second charging bias V2 after startup will be equal to the reference value ΔYM2. In this example, the conditions before and after the startup do not change, and thus a large amount of electric current will not flow through the wire electrode 521Y. Consequently, the controller 130 determines that the wire electrode 521Y is not in need of cleaning.

If the wire electrode 521M, which is contaminated more than the wire electrode 521Y, is subjected to cleaning, the resistance of the wire electrode 521M will be lowered (see map 521M indicated by a chain double-dashed line). Therefore, the amount of a charging current AM2' caused to flow through the wire electrode 512M by application of the second charging bias V2 after the startup will be greater than the amount of the charging current AM2, and the difference ΔYM4 between the amounts of charging electrodes AM2' and AY2 will be smaller than the reference value ΔYM2. Consequently, a large amount of an electric current will become unlikely to flow through the wire electrode 521Y, and thus the controller 130 will determine that the wire electrode 521Y is not in need of cleaning.

On the other hand, if the wire electrode 521Y, which is not so contaminated as the wire electrode 521M, is subjected to cleaning, the resistance of the wire electrode 521Y will be lowered (see map 521Y indicated by a chain double-dashed line). Therefore, the amount of a charging current AY2' caused to flow through the wire electrode 521Y by application of the second charging bias V2 after the startup will be greater than the mount of the charging current AY2, and the difference ΔYM3 between the amounts of charging electrodes AY2' and AM2 will be greater than the reference value ΔYM2. Consequently, a large amount of an electric current will disadvantageously become likely to flow through the wire electrode 521Y, and thus the controller 130 will determine that at least one of the wire electrodes 521 of which the amount of charging current flowing therethrough is smaller is in need of cleaning.

Although the above-described embodiment is configured such that a determination as to whether or not each wire electrode 521Y, 521M, 521C is in need of cleaning is made based upon the difference between a maximum amount found to be largest among the obtained amounts of the charging currents and each of the obtained amounts other than the maximum amount, the present invention is not limited to this specific configuration. For example, the determination may be made based upon a difference between any pair of two amounts selected among the obtained amounts of charging currents. Furthermore, although the determination as to whether or not each wire electrode is in need of cleaning is made in the above-described embodiment based upon the difference between two amounts of electric currents obtained after the startup, the present invention is not limited to this specific configuration. For example, the determination may be made based upon a difference between amounts of electric currents obtained for each color before and after the startup (i.e., between a previous value recorded and a currently obtained value).

In the above-described embodiment, the color printer 1 (image forming apparatus) is configured to start up and initiate the warming-up operation (constant-voltage control) when the upper cover 11 is operated from an open position to a closed position, but the present invention is not limited to this configuration. For example, the image forming apparatus may be configured to start up and initiate the constant-voltage control, not only when the cover is closed but also when the power switch is turned on. Moreover, the image forming apparatus may be configured to enter the so-called "sleep" mode when no operation is performed for a predetermined time after the warming-up operation is initiated, and to start up and initiate the constant-voltage control when the image forming apparatus exits the sleep mode in response to receipt of a printing job.

In the above-described embodiment, the charger 52 is configured to be a scorotron type charger comprising a wire electrode 521 and a grid electrode 522 by way of example, but the present invention is not limited to this specific configuration. For example, the charger consistent with the present invention may be a corotron type charger including no grid electrode. Furthermore, although the charging member adopted in the above-described embodiment is configured as a charger 52 including a wire electrode 521, the present invention is not limited to this specific configuration; for example, a charging member consistent with the present invention may be configured as a pin array charger including an array of pin-like electrodes.

In the above-described embodiment, the charging current flowing through the wire electrode 521 (charging member) is detected by measuring an electric current flowing through the grid electrode 522, but the present invention is not limited to this specific configuration; for example, an electric current flowing a charging member may be directly measured, instead. Specific configuration usable for detecting an electric current is not limited to the exemplified one but may be any known configuration without limitation.

In the above-described embodiment, the upper cover 11 configured to openably close an opening 10A formed at an upper side of the main body housing 10 is adopted as an example of a cover of the present invention, but the present invention is not limited to this example. Alternatively, a front cover for openably closing an opening formed at a front side of the main body housing or a side cover for openably closing an opening formed at a left side or right side of the main body housing may be provided instead and configured in a manner consistent with the present invention.

In the above-described embodiment, the color printer 1 (image forming apparatus) comprises four process units 50 and is configured to form four-color image, but the present invention is not limited to this specific configuration. For example, the image forming apparatus consistent with the present invention may comprise three process units and be configured to form three-color image, or may comprise two process units and be configured to form two-color image (e.g., the image forming apparatus comprising a process unit for black and a process unit for red may be configured in accordance with the present invention).

In the above-described embodiment, the present invention is applied to the color printer 1, but the present invention is not limited thereto. Any other type of image forming apparatus such as a photocopier with or without a flatbed scanner or other type of document reading device, a multifunction peripheral, etc. may be configured in accordance with the present invention.

In the above-described embodiment, positively chargeable toner is used as developer by way of example, but developer usable in an image forming apparatus consistent with the present invention is not limited thereto. Negatively chargeable toner may be used instead.

What is claimed is:

1. An image forming apparatus comprising:

a plurality of photoconductors;

a plurality of chargers each disposed opposite to a corresponding photoconductor, the plurality of chargers comprising a plurality of charging members each of which is provided in a corresponding charger and configured to charge the corresponding photoconductor by a corona discharge;

a voltage application unit to which the charging members are connected in parallel and which is configured to apply a voltage to the charging members;

a memory unit;

a controller configured to exercise control over the voltage application unit; and a messaging unit configured to produce a notification to advise a user of presence or absence of an anomaly, wherein the controller is further configured:

to change, upon startup of the image forming apparatus, the voltage to be applied by the voltage application unit to the charging members from a first voltage to a second voltage of which an absolute value is smaller than that of the first voltage, to obtain amounts of electric currents caused to flow through the respective charging members by application of the second voltage, the first voltage being a previously applied voltage stored in the memory unit;

to make a determination as to whether or not any anomaly is present, based upon the obtained amounts of the electric currents for the charging members; and to cause the messaging unit to produce a notification of the anomaly being present, if any anomaly is present, and wherein the notification produced by the messaging unit includes information that there are one or more charging members in need of cleaning.

2. The image forming apparatus according to claim 1, wherein the controller is further configured to calculate an absolute value of a difference between a maximum amount found to be largest among the obtained amounts of the electric currents and another or each of the obtained amounts other than the maximum amount, whereby if there is at least one charging member of which an amount of an electric current is not the maximum amount and for which the calculated absolute value is equal to or greater than a first reference value, the controller makes a determination that an anomaly is present and causes the messaging unit to produce a notification to advise a user that the at least one charging member is in need of cleaning.

3. The image forming apparatus according to claim 1, further comprises:

a main body housing having an opening; and a cover provided at the main body housing to openably close the opening, wherein the startup of the image forming apparatus which serves as a trigger for starting applying the second voltage to the charging members is timed to occur when the cover is operated from an open position to a closed position.

4. An image forming apparatus comprising:

a plurality of photoconductors;

a plurality of chargers each disposed opposite to a corresponding photoconductor, the plurality of chargers comprising a plurality of charging members each of which is provided in a corresponding charger and configured to charge the corresponding photoconductor by a corona discharge;

a voltage application unit to which the charging members are connected in parallel and which is configured to apply a voltage to the charging members;

a memory unit;

a controller configured to exercise control over the voltage application unit; and a messaging unit configured to produce a notification to advise a user of presence or absence of an anomaly, wherein the controller is further configured:

to change, upon startup of the image forming apparatus, the voltage to be applied by the voltage application unit to the charging members from a first voltage to a second voltage of which an absolute value is smaller than that of the first voltage, to obtain amounts of electric currents caused to flow through the respective charging members by application of the second voltage, the first voltage being a previously applied voltage stored in the memory unit;

to make a determination as to whether or not any anomaly is present, based upon the obtained amounts of the electric currents for the charging members; and to cause the messaging unit to produce a notification of the anomaly being present, if any anomaly is present, and wherein the charging members connected in parallel to the voltage application unit comprise a first charging member and a second charging member, and the controller is further configured to calculate an absolute value of a difference between amounts of electric currents caused to flow through the first and second charging members by application of the second voltage, whereby if the calculated absolute value is greater than a second reference value predetermined based upon amounts of electric currents caused to flow through the first and second charging members by application of the first voltage, the controller makes a determination that anomaly is present.

5. An image forming apparatus comprising:

a plurality of photoconductors;

a plurality of chargers each disposed opposite to a corresponding photoconductor, the plurality of chargers comprising a plurality of charin members each of which is provided in a corresponding charger and configured to charge the corresponding photoconductor by a corona discharge;

a voltage application unit to which the charging members are connected in parallel and which is configured to apply a voltage to the charging members;

a memory unit;

a controller configured to exercise control over the voltage application unit; and a messaging unit configured to produce a notification to advise a user of presence or absence of an anomaly, wherein the controller is further configured:

to change, upon startup of the image forming apparatus, the voltage to be applied by the voltage application unit to the charging members from a first voltage to a second voltage of which an absolute value is smaller than that of the first voltage, to obtain amounts of electric currents caused to flow through the respective charging members by application of the second voltage, the first voltage being a previously applied voltage stored in the memory unit;

to make a determination as to whether or not any anomaly is present, based upon the obtained amounts of the electric currents for the charging members; and to cause the messaging unit to produce a notification of the anomaly being present, if any anomaly is present, wherein the plurality of chargers further comprise a plurality of grid electrodes each of which is disposed between a corresponding photoconductor and a corresponding charging member, and wherein the controller is further configured to obtain amounts of electric currents flowing through the grid electrodes, as the amounts of electric currents flowing through the corresponding charging members.

* * * * *